US005156265A

United States Patent [19]

Platt

[11] Patent Number: 5,156,265

[45] Date of Patent: Oct. 20, 1992

[54] FOLDABLE PAPERBOARD DISPLAY CARTON FORMED FROM A UNITARY BLANK

[75] Inventor: Ronald Platt, Harvard, Ill.

[73] Assignee: The Packaging House, Inc., Chicago, Ill.

[21] Appl. No.: 597,050

[22] Filed: Oct. 15, 1990

[51] Int. Cl.[5] ..... B65D 5/52

[52] U.S. Cl. ..... 206/45.25; 229/120.11

[58] Field of Search ..... 206/45.25, 45.24, 425, 206/44 R; 229/164, 120.11

[56] References Cited

U.S. PATENT DOCUMENTS

| | | | |
|---|---|---|---|
| 769,535 | 9/1904 | DeLaney | 206/44 R X |
| 2,138,460 | 11/1938 | Ringler | 206/45.25 |
| 2,159,887 | 5/1939 | Darragh | 206/45.25 |
| 2,175,513 | 10/1939 | Bauman | 206/45.25 |
| 2,344,182 | 3/1944 | Taylor | 206/44 R |
| 2,361,840 | 10/1944 | Hauton et al. | 206/45.25 |
| 2,818,971 | 7/1958 | Stone . | |
| 3,160,274 | 12/1964 | Pritchard | 206/44 R |
| 3,334,733 | 8/1967 | Ebelhardt | 206/44 R |
| 3,568,911 | 3/1971 | Bebout | 229/120.11 X |
| 4,149,630 | 4/1979 | Transport . | |
| 4,311,233 | 2/1982 | Austin . | |
| 4,579,232 | 11/1986 | Fedak . | |
| 4,938,344 | 7/1990 | McHale et al. | 206/45.25 |
| 4,991,804 | 2/1991 | Lannucci | 206/45.24 X |

*Primary Examiner*—Paul T. Sewell
*Assistant Examiner*—Jacob K. Ackun, Jr.
*Attorney, Agent, or Firm*—Jones, Day, Reavis & Pogue

[57] ABSTRACT

A cardboard display device with easel that is collapsible and constructed and assembly from a unitary paperboard blank. The display device is an automatic set up type with an extremely simple locking action. The easel is not cut out of the display and therefore does not weaken the structure. The rigid, girder like structure is capable of supporting heaving weights placed in the display. The device is easily assembled and disassembled.

9 Claims, 2 Drawing Sheets

FIG. 1
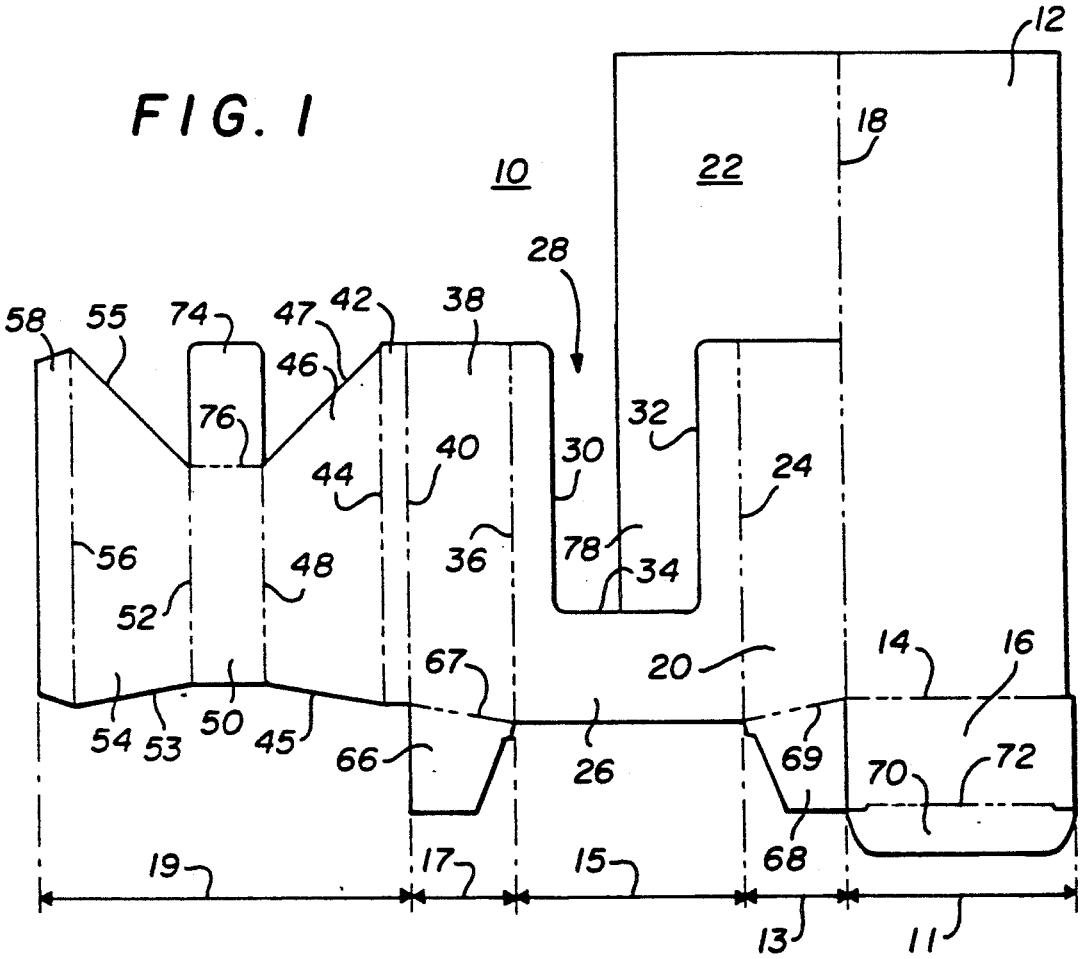
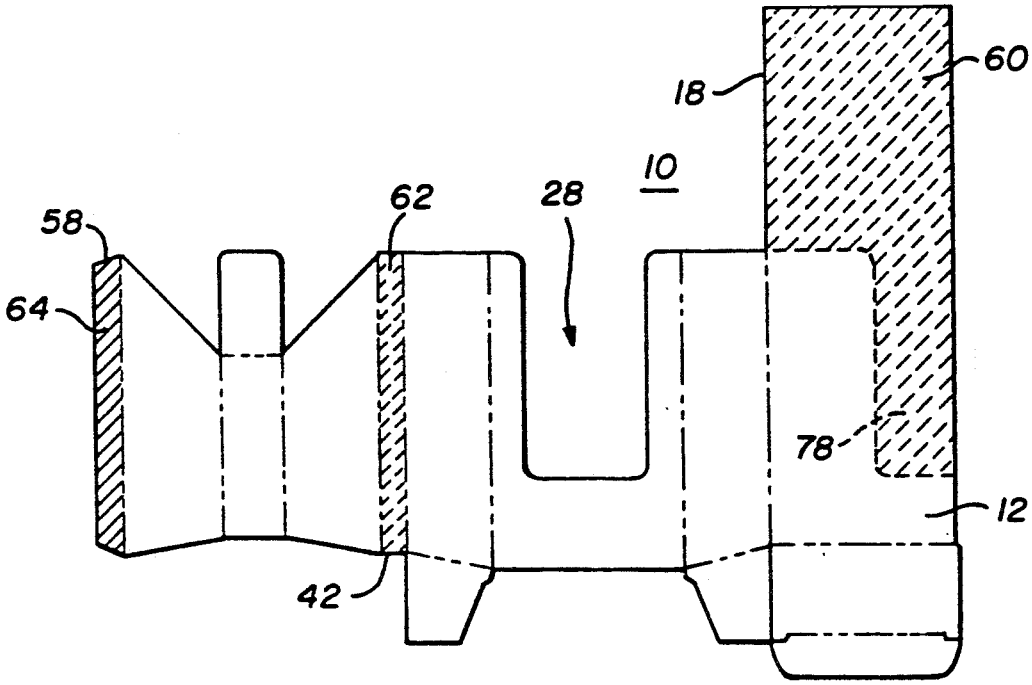
FIG. 2

FOLDABLE PAPERBOARD DISPLAY CARTON FORMED FROM A UNITARY BLANK

FIELD OF THE INVENTION

The invention relates generally to paperboard construction of boxes and cartons and is more specifically directed to a paperboard carton that is collapsible and that has an easel support that is also collapsible and supports the carton in its assembled state for display of articles of merchandise and/or informational materials such as pamphlets or brochures. The assembled carton, in its display position, is supported at an angle to the surface on which it is placed to prevent product from falling forward and allow the display to be directly viewed on the counter or surface on which the display is placed.

BACKGROUND OF THE INVENTION

There are numerous display racks, folding boxes and display cartons in the prior art. These devices are usually made of a unitary paperboard blank and are cut, scored and folded so as to form a container for displaying objects. Many of the displays have a collapsible easel support for maintaining the carton in its erected position holding articles to be displayed.

Some carton have two leg panels hingedly attached to the back panel of the carton and are foldable into an angular position for supporting the carton. Such easels are usually manufactured separately and glued to the back of the display carton because they need to be made of a heavier material than the material of which the carton is made. In other types of easels, such as disclosed in U.S. Pat. No. 4,149,630, the easel is formed as a portion of the back panel and has to be moved out of the back panel in order to assemble the easel when the carton is erected. This construction weakens the structure because the easel is cut out of the back wall of the display itself. Other easel supports are formed as triangular pyramids, triangles, and other systems that are complicated to set up and are not sturdy because of the manner of construction.

The present invention overcomes these disadvantages of the prior art by providing a unitary paper blank that is cut, scored, folded, and glued to form a collapsible display carton having a box portion and a collapsible easel support as an integral part thereof. The easel is an elongated one piece hollow support, rectangular in cross-section and is an integral extension of the box portion and is attached to and extends upwardly along the back wall from the bottom wall to support the carton in its assembled state for holding articles. The support has a stay flap integrally formed with and extending from a top edge of one side of the elongated support for foldably engaging an opposite side of the hollow support and holding the support in its rectangular cross-section so as to support the hollow box portion or carton portion in an upright position to display articles contained therein.

The unitary paper blank comprises a back portion section, a first side wall portion, a front wall portion, a second side wall portion, and the easel support section as integral extension of each other. In addition, the unitary blank has an additional integrally formed partial panel for mating with and supporting the back wall panel to give it strength. The bottom edges of the two side walls and the bottom edges of the support are angled from the front to the back in a sloping manner so as to allow the entire container to sit at an angle in its assembled state for a more clearer viewing of the articles contained therein.

Thus it is an object of the present invention to provide a foldable paperboard display carton having an easel support that is integrally formed as a separate extension the unitary blank so as to strengthen and not weaken the back wall of the carton.

It is also an object to the present invention to provide a carton with a collapsible easel support that has bottom edges that slope from the front to the back to support an assembled carton so that it stands at an angle to the surface.

It is still another object to the present invention to provide an elongated one piece hollow support rectangular in cross-section and integrally formed with the box portion and attached to and extending upwardly along the back wall from the bottom wall.

It is also an object of the present invention to provide a foldable paperboard display carton that is an automatic type setup extremely simple to assemble and having positive locking action.

SUMMARY OF THE INVENTION

Thus the invention relates to a foldable paperboard display carton assembled from a unitary blank and comprising a hollow box portion having a rectangular cross-section, a back wall of a first height, a front wall and side walls of a second lower height, and a selectively closable bottom wall, the rectangular box portion being capable of holding and displaying articles, an elongated one piece hollow support that is rectangular in cross-section, has top and bottom edges, is integrally formed with the box portion, is attached to and extends upwardly along the back wall from the bottom wall, and has a stay flap integrally formed with and extending from a top edge of one side of the elongated support for foldably engaging an opposite side of the hollow support to hold the support in its rectangular cross-section so as to maintain the hollow box portion in an upright position to display articles contained therein, the carton being foldable to a substantially flat state when the selectively closable bottom wall is opened and the stay flap is removed from foldable engagement with an opposite side of the elongated support.

The invention also relates to a collapsible paperboard easel support for supporting a display carton on a surface at an angle comprising an elongated U-shaped support having a glue flap hingedly connected along each leg of the U for attachment to the back of the display carton to form a collapsible support rectangular in cross-section when assembled and a stay flap integrally formed with and hingedly connected to a top edge of the U for foldably engaging an opposing surface of the rectangular support to maintain the support with its rectangular cross section.

BRIEF DESCRIPTION OF THE DRAWINGS

These and other objects of the present invention will be more clearly understood in conjunction with the accompanying drawings in which like numerals represent like elements and in which:

FIG. 1 is a plan view of the paper board blank used in the present invention;

FIG. 2 is a plan view of the paper board blank with the back wall support panel being folded under and glued to the back wall of the carton;

DETAILED DESCRIPTION OF THE DRAWINGS

Figure 3:
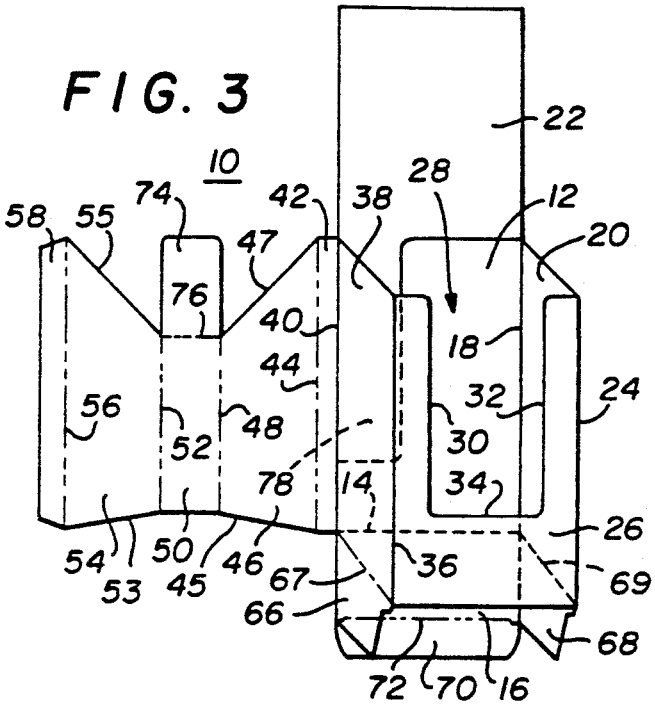
FIG. 3 is a partially folded view of the carton illustrating the back wall, side walls and front wall assembled to form a box portion rectangular in cross-section and with the support section being hingedly attached to one corner of the box portion.

FIG. 1 is a plan view of the unitary paperboard blank from which the stand alone display carton of the present invention is constructed. As indicated below in FIG. 1, the blank 10 is composed of the back wall section 11, first side wall section 13, front wall section 15, second side wall section 17 and the support section 19. Hingedly coupled at score line 14 to the bottom edge of back wall 12 is bottom wall 16 with lip 70 hingedly attached thereto at score line 72. A rectangular U-shaped opening 28 is formed in front wall 26 which will enable a more complete viewing of articles contained in the box portion of the carton when assembled. The rectangular opening 28 in front wall 26 extends downwardly from the top of the front wall to increase the amount of display of the articles.

The bottom edges 67 and 69 of the side walls 20 and 38 slope from the front to the back to cause the display to tilt to the rear for a more clear display of the articles contained therein when assembled.

Figure 6:
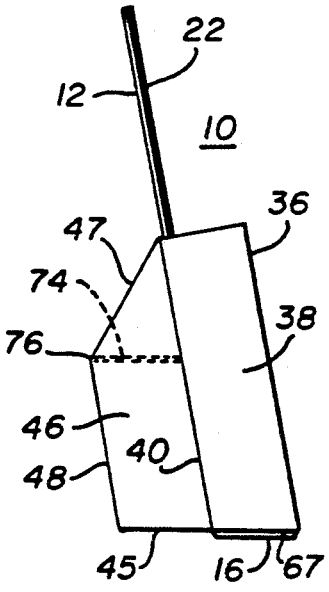
FIG. 6 is a side view of the novel carton.

When assembled, the back wall 12, front wall 26 and side walls 20 and 38 form a hollow box portion having a rectangular cross-section capable of holding and displaying articles. The support section 19, when assembled, forms an elongated one piece hollow support rectangular in cross-section when glued to the carton back wall 12. It is integrally formed with the rest of the paper blank by being hingedly attached at score line 40 to side wall 38. Clearly it could be hingedly attached to the outer edge of carton back wall 12 instead of carton side wall 38. It is attached to and extends upward along the back wall 12 from the bottom edge 14 when attached thereto. The support section 19 of blank 10 comprises a first glue panel 42 having one side edge integrally formed with and extending outwardly about a score line 40 from the side wall 38. The glue panel 42 is folded about score line 40 for a glue attachment to the back of the back wall 12. A first support side panel 46 has one side edge 44 hingedly attached to the other edge of the glue panel 42. A support back panel 50 is hingedly attached to the other side edge 48 of the first support side panel 46. A second support side panel 54 is hingedly attached to the other side edge 52 of the back panel 50. Finally, a second glue panel 58 is hingedly attached to the other side edge 56 of the second support side panel 54 and folded about score line 56 for a glue attachment to the back surface of the carton back wall 12 so as to form a rectangular support that is collapsible. In the preferred embodiment, a stay flap 74 is integrally formed with and extends from the hinged top edge 76 of the support back panel 50 of the elongated support section 19 for foldably engaging the back of carton back wall 12 as illustrated in FIG. 6 to hold the support in its rectangular cross-section so as to support the hollow box portion of the carton in an upright position to display articles contained therein. The carton is foldable to a substantially flat state when the selectively closable bottom wall 16 is open and the stay flap 74 is removed from folding engagement with an opposite side of the elongated support. The stay flap 74 has a vertical height from hinge 76 that is equal to or less than the vertical component of the sloped top edges 47 and 55 of side panels 46 and 54. Thus the stay flap 74 does not project above the uppermost edge of side panels 46 and 54 to conserve paper when the unitary blank 10 is cut and formed. Clearly the stay flap 74 could be integrally formed with and extend from either of the sloped edges 47 and 55 but in such case would extend above the uppermost edge of side panels 46 and 54 and would not conserve paper. Stay flap 74 could also be an integral extension of the bottom edge of back panel 50 or bottom edges 45 and 53 of side panels 46 and 54, respectively, instead of top edge or hinge 76. If extended from bottom edges 45 and 53, stay flap 74 could extend downwardly perpendicular to edges 45 and 53 a distance equal to the width of back panel 50 as determined by top edge 76 or the bottom edge of panel 50.

FIG. 2 is a plan view of the blank in its partially folded state with the back wall support plate 22 folded under back wall 12 about score line 18 and glued thereto by means of adhesive indicated with dashed lines designated by the numeral 60. Plate 22 has a projection 78 extending downwardly therefrom and coterminous with edge 32 of U-shaped opening 28 as shown in FIG. 1. Plate 22, as a whole, strengthens and supports back wall 12 of the carton. With the back wall support plate 22 in the position indicated in FIG. 2, the front wall 26 with its U-shaped rectangular opening 28 can be clearly seen.

In FIG. 3, the box portion of the foldable carton is illustrated in its assembled condition. In this illustration, back wall 12 and its attached support plate 22 is shown folded to the rear about score line 18 while first side wall 20 is shown folded about score line 24 and second side wall 38 is shown folded about score line 36 to form the box having a rectangular cross-section. The bottom wall 16 including integrally formed lip 70 and side flaps 66 and 68 extending from the bottom edges 67 and 69 respectively of the side walls 20 and 38 are also shown.

Figure 4:
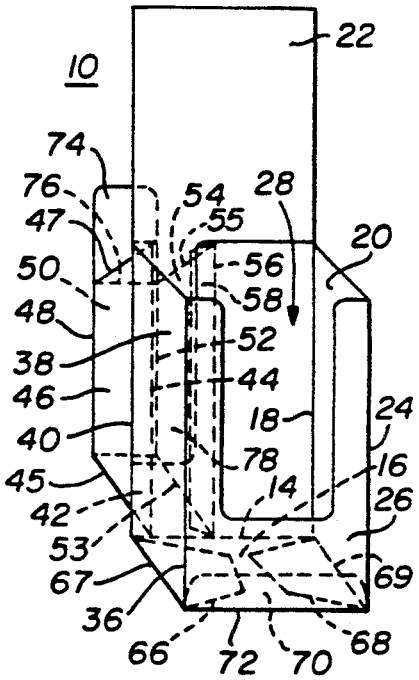
FIG. 4 is an isometric view of the carton in its assembled condition.
Figure 5:
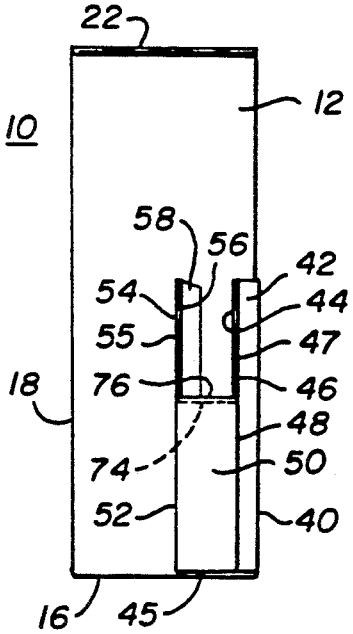
FIG. 5 is a back view of the novel carton.
Figure 7:
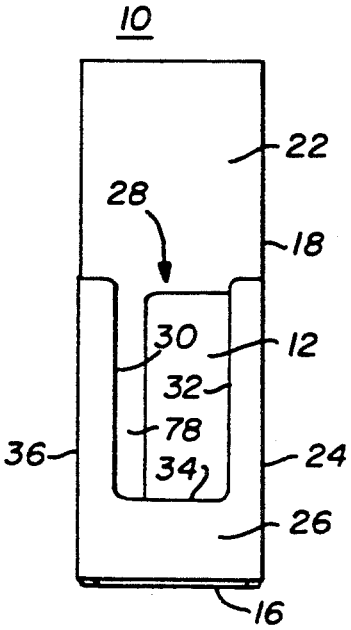
FIG. 7 is a front view of the assembled carton.

In FIG. 4 the carton is illustrated in its completely folded condition. It will be noted in FIG. 4 that back wall 12 and its attached support plate 22 has a first height while front wall 26 and first and second side walls 20 and 38 have a second, lower height. This construction enables articles, such as pamphlets, that extend above front wall 26 and side walls 20 and 38, to be supported by back wall 12. It will be seen in FIG. 4 that the first glue panel 42 has been folded about score line 30 and glued to the back wall 12. The entire carton in that condition could be folded and collapsed if necessary. Further, the back panel 50 of the support section 19 has been folded about score line 48 with the first support side panel 46 and about score line 52 with second support side panel 54 to form the rectangular shaped support assembly 19 when attached to the back wall 12. The other glue panel 58 is folded about score line 56 and glued to the back of back wall 12. This can be seen more clearly in the back view of FIG. 5 wherein the first glue panel 42 is glued along the edge of the back wall 12 and the second glue panel 58 is glued to back wall 12 along edge 56 of support side panel 54. The edges of side panels 54 and 56 can be clearly seen in FIG. 5.

FIG. 6 is a side view of the assembled display carton shown in FIG. 4. There it can be seen clearly how the support assembly attaches to the back wall 12 of the carton. It also clearly shows how the stay flap 74 is pivoted about score line 76 to foldably engage with the opposite side of the hollow support which, when glued, is back wall 12. Stay flap 74 frictionally engages the back of back wall 12 to hold the rectangular support 19 in its rigid rectangular shape. It can easily be collapsed of course by folding stay flap 74 outwardly about score line 76 so that it no longer engages the back wall 12 of the carton. Note also in FIG. 6 that the bottom edges 45 of support side panel 46 and bottom edge 67 of carton side wall 38 are sloped from the front to the back to cause the display carton to tilt to the rear for a more clear display of the articles contained therein.

Thus it will be seen from the figures that the support section 19 for the carton is not formed in any manner from the back wall 12 of the carton and thus does not weaken the carton and yet is simple and easy to assemble, is collapsible and can be shipped in a flattened state and assembled at the site of use. It provides a very simple locking action with the stay flap to hold the carton in its assembled condition.

Clearly, the bottom wall 16 need not be limited to the preferred embodiment with lip 70 that can be tucked in against front wall 26, as best shown in FIG. 4, but could encompass other well-known constructions.

Thus there has been disclosed a novel cardboard display device with an easel that is an automatic type setup with an extremely simple locking action. The easel is not cut out of the display back or any other portion and therefore does not weaken the structure. Thus the rigid structure is capable of supporting heavy weights placed in the display. Further, it is extremely easy to assemble the carton to its final state. The U-shaped rectangular opening in the front wall that extends downwardly from the top of the front wall increases the amount of the display of the articles contained in the carton.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having equivalent function.

What is claimed is:

1. A foldable paperboard display carton formed from a unitary blank and comprising:

a hollow box portion having a rectangular cross-section, a back wall of a first height, a front wall and side walls of a second lower height, and a bottom wall, the rectangular box portion being capable of holding and displaying articles;

an elongated one-piece hollow support that is substantially uniformly rectangular in cross-section, with first and second side panels and a back panel, which has top and bottom edges, is integrally formed with the box portion and is attached to and extends upwardly along the back wall from the bottom wall;

a stay flap integrally formed with and extending from one of the side panel edges or back panel edges of the elongated support for foldably and releasably engaging an opposite side of the hollow support to hold the support in its rectangular cross-section so as to maintain the hollow box portion in an upright position to display articles contained therein, said carton being foldable to a substantially flat state when the selectively closable bottom wall is opened and the flap is released from foldable engagement with an opposite side of the elongated support; and said bottom edges on the hollow rectangular support sloping from the front to the back to cause the display carton to tilt to the rear for a more clear display of the articles contained therein.

2. A display carton as in claim 1 further including a rectangular opening in the front wall to enable viewing of the articles contained in the box portion.

3. A display carton as in claim 2 wherein the rectangular opening in the front wall is U-shaped and extends downwardly from the top of the front wall to increase the amount of display of the articles.

4. A paper board blank for forming a foldable display carton comprising:

a rectangular back wall having top and bottom edges and side edges;

a first side wall having top and bottom edges and side edges, one of the side edges of the first side wall being hingedly connected at least to a portion of one of the side edges of the back wall and extending upwardly from the bottom edge of the back wall;

a front wall having side edges and a bottom and top edge, one of the side edges being hingedly connected to the other side edge of the first side wall;

a second side wall having top and bottom edges and side edges, one of the side edges of the second side wall being hingedly connected to the other side edge of the front wall;

a first glue strip having top and bottom edges and side edges, one of the side edges being hingedly connected to the other side edge of the second side wall to enable to blank to be folded about the hinge connections separating the back wall, first side wall, the front wall and the second side wall to form a hollow carton with rectangular cross-section, the first glue strip being foldable over the back wall about the hinge connecting it to the second side wall for gluing thereto;

a first support side panel having top and bottom edges and side edges, one of the side edges being hingedly connected to the other side edge of the first glue strip;

a support back panel having top and bottom edges and side edges, one of the side edges being hingedly connected to the other side edge of the first support side panel;

a second support side panel having top and bottom edges and side edges, one of the side edges being hingedly connected to the other side edge of the support back panel;

a second glue strip having top and bottom edges and side edges, one of the side edges being hingedly connected to the other side edge of the second support side panel such that the first and second support side panels and the support back panel are foldable along the connecting hinges to form a one piece, four sided, elongated hollow support rectangular in cross-section when the second glue strip is folded about the one side edge for gluing to the rectangular carton back wall; and a stay flap hingedly connected to the top edge of one of the first, second and back support panels for foldably engaging an opposite side of the rectangular support to hold the support in its rectangular cross-section shape and support the carton when it is in its assembled state.

5. A blank as in claim 4 further comprising:

a bottom wall having side edges and a foldable lip on one side edge and hingedly connected at the other side edge to the bottom edge of the rectangular back wall; and a tab hingedly connected to the bottom edge of each of the first and second side walls such that when the carton is assembled by folding the back wall, the first and second side walls and the front wall about their respective hinge connections to form a carton rectangular in cross-section, the tabs are folded inwardly about the bottom edges of the first and second side walls and the bottom wall is folded inwardly about the bottom edge of the back wall with the lip folded upwardly to rest against the inside of the front wall so as to form a bottom panel for the assembled carton.

6. A blank as in claim 5 wherein the bottom edges of the first and second side walls and the bottom edges of the first and second support side panels are sloped from front to back to cause the assembled carton to tilt to the rear for a more clear display of the articles contained therein.

7. A blank as in claim 4 wherein said back wall extends above the top edge of the front wall and said front wall has a rectangular U-shaped opening extending downwardly from the top thereof to increase the area of display of the articles contained in the assembled carton.

8. A blank as in claim 7 further comprising a back wall support plate having top and bottom edges and side edges, one of the side edges being hingedly connected to the remaining portion of the side edge of the back wall that is hingedly connected to the first side wall, the back wall support plate having a projection extending down into and coterminous with one side of the U-shaped opening in the front wall and a portion of the bottom edge of the U-shaped opening; said back wall support plate, when folded about the hinge connection and glued to the back wall, providing added support for the back wall.

9. A foldable paperboard display carton formed from a unitary blank and comprising:

a hollow box portion having a rectangular cross-section, a back wall of a first height, a front wall and side walls of a second lower height, and a bottom wall, the rectangular box portion being capable of holding and displaying articles; and an elongated one-piece hollow support that is rectangular in cross-section, has top and bottom edges, is integrally formed with the box portion and is attached to and extends upwardly along the back wall from the bottom wall; the one-piece hollow support further comprising:

a first glue panel having side edges with one side edge integrally formed with and extending outwardly from the box portion about a score line for glue attachment to the back of the back wall;

a first side panel having side edges with one side edge hingedly attached to the other side edge of the glue panel;

a back panel having side edges with one side edge hingedly attached to the other side edge of the first side panel;

a second side panel having side edges with one side edge hingedly attached to the other side edge of the back panel;

a second glue panel having side edges with one side edge hingedly attached to the other side edge of the second side panel and folded about its said one side edge for a glue attachment to the back of the back wall so as to form with the box portion a hollow support that is rectangular in cross section; and a stay flap integrally formed with and extending from a top edge of one of the first side panel, back panel or the second side panel of the elongated support for foldably engaging an opposite side of the hollow support to hold the support in its rectangular cross-section so as to maintain the hollow box portion in an upright position to display articles contained therein, said carton being foldable to a substantially flat state when the selectively closeable bottom wall is opened and the stay flap is removed from foldable engagement with an opposite side of the elongated support.

* * * * *